US005128658A

United States Patent [19]

Pappas et al.

[11] Patent Number: 5,128,658

[45] Date of Patent: Jul. 7, 1992

[54] PIXEL DATA FORMATTING

[75] Inventors: James L. Pappas, Leominster; Larry D. Seiler, Boylston; Robert C. Rose, Hudson, all of Mass.

[73] Assignee: Digital Equipment Corporation, Maynard, Mass.

[21] Appl. No.: 211,778

[22] Filed: Jun. 27, 1988

[51] Int. Cl.[5] ..... G09G 5/06

[52] U.S. Cl. ..... 340/703; 340/721

[58] Field of Search ..... 340/703, 721, 723, 747, 340/799, 701, 793

[56] References Cited

U.S. PATENT DOCUMENTS

| | | | |
|---|---|---|---|
| 4,075,620 | 2/1978 | Passavant et al. | 340/799 |
| 4,484,187 | 11/1984 | Brown et al. | 340/703 |
| 4,493,078 | 1/1985 | Daniels | 371/25 |
| 4,542,376 | 9/1985 | Bass et al. | 340/721 |
| 4,545,070 | 10/1985 | Miyagawa et al. | 382/48 |
| 4,577,318 | 3/1986 | Whitacre et al. | 371/1 |
| 4,631,724 | 12/1986 | Shimizu | 371/21 |
| 4,642,790 | 2/1987 | Minshull et al. | 364/900 |
| 4,670,752 | 6/1987 | Marcoux | 340/721 |
| 4,694,288 | 9/1987 | Harada | 340/721 |
| 4,703,317 | 10/1987 | Shiomi et al. | 340/723 |
| 4,710,767 | 12/1987 | Sciacero et al. | 340/790 |
| 4,749,947 | 6/1988 | Gheewala | 324/73 |
| 4,769,762 | 9/1988 | Tsujido | 340/721 |
| 4,772,881 | 9/1988 | Hannah | 340/703 |
| 4,808,986 | 2/1989 | Mansfield et al. | 340/747 |
| 4,823,120 | 4/1989 | Thompson et al. | 340/703 |
| 4,827,251 | 5/1989 | Aoki et al. | 340/703 |

*Primary Examiner*—Jeffery A. Brier
*Attorney, Agent, or Firm*—Cesari and McKenna

[57] ABSTRACT

Pixel formats and a pixel mapping unit for use in a computer graphics terminal which provides an address input to a color look-up table. The disclosed pixel formats can be used to conserve frame buffer memory, color table memory, or both. For example, the formats support pseudo color or full color mapping, overlay planes, and color table bank select while using a minimum amount of memory. A valid plane feature is also supported, which can be used to enable rapid clearing of a window. The pixel mapping unit is especially handy in supporting multiple windows, because a unique mapping configuration word, which specifies how pixels are to be interpreted, may be specified for each window.

20 Claims, 10 Drawing Sheets

```
IF MODE = OOB
   IF MASK<3:O>.AND. (PIXEL> SHIFT)<P+3:P> = O
      B<11:O> := G<11:O> := R<11:O> :=
         BASE + (PIXEL>SHIFT)<P-1:O>
   ELSE
      B<11:O> := G<11:O> := R<11:O> :=
         BASE + { (PIXEL> SHIFT)<P+3:P> } COMPACTED
   ENDIF
ENDIF
```

```
IF MODE = 01B
    IF Q=0B
       OV<3:0>  := PIXEL<27:24>
    ELSE
       OV<3>  :=  (PIXEL>>SHIFT) < 17>
       OV<2>  :=  (PIXEL>>SHIFT)  <0>
       OV<1>  :=  (PIXEL>>SHIFT)  <8>
       OV<0>  :=  (PIXEL>> SHIFT) <16>
    ENDIF
    IF MASK<3:0> .AND.  OV<3:0> = 0
       B<11:0> :=    BASE + (PIXEL>>SHIFT)<16+P-1:16>
       G<11:0> :=    BASE + (PIXEL>>SHIFT)< 8+P-1: 8>
       R<11:0> :=    BASE + (PIXEL>>SHIFT)<P-1:0>
    ELSE
       B<11:0)  := G<11:0>  := R<11:0>:=
                BASE - {OV<3:0>} COMPACTED
    ENDIF
ENDIF
```

FIG. 4A

```
IF MODE = 10B THEN
    IF (PIXEL>>SHIFT) <0> = 0B THEN
       B<11:0>  := G<11:0> := R<11:0>:= BGD + BITONAL_BASE
    ELSE
       B<11:0>  := G<11:0> := R<11:0>:= FGD + BITONAL_BASE
    ENDIF
ENDIF
```

```
IF MODE = 11B
    IF Q=0B
        OV<3:0>  :=  PIXEL<27:24>
    ELSE
        OV<3>  :=  (PIXEL>>SHIFT)<17>
        OV<2>  :=  (PIXEL>>SHIFT) <0>
        OV<1>  :=  (PIXEL>>SHIFT) <8>
        OV<0>  :=  (PIXEL>>SHIFT) <16>
    ENDIF
    B<11:0>  :=  BASE + ( {OV} COMPACTED<<P) + (PIXEL>> SHIFT)<16+P-1:16>
    G<11:0>  :=  BASE + ( {OV} COMPACTED<<P) + (PIXEL>>SHIFT)<8+P-1:8>
    R<11:0>  :=  BASE + ( {OV} COMPACTED<<P) + (PIXEL>>SHIFT)<P-1:0>
ENDIF
```

FIG. 6A

```
IF V=1B .AND. VDATA=0B THEN
    B<11:0> : WINDOW<5:0> + BGD_BASE
    G<11:0> : WINDOW<5:0> + BGD_BASE
    R<11:0> : WINDOW<5:0> + BGD_BASE
ELSE
    normal operation in selected mode
ENDIF
```

PIXEL DATA FORMATTING

CROSS-REFERENCE TO RELATED APPLICATIONS

This invention is related to the following co-pending applications, all of which are assigned to the assignee of this application as of the date of filing:

Apparatus and Method for Specifying Windows with Priority Ordered Rectangles in a Computer Video Graphics System, Ser. No. 07/205,030 filed June 13, 1988;

Pixel Lookup In Multiple Variably-Sized Hardware Virtual Colormaps In A Video Graphics System, Ser. No. 07/206,026 filed June 13, 1988;

Datapath Chip Test Architecture, Ser. No. 07/206,194 filed June 13, 1988;

Window Dependent Pixel Datatypes in a Computer Video Graphics System, Ser. No. 07/206,031 filed June 13, 1988;

Sprite Cursor with Edge Extension and Clipping, Ser. No. 07/213,917 filed June 29, 1988;

Window-Dependent Buffer Selection, Ser. No. 07/213,819 filed June 28, 1988;

Extendible-Size Color Look Up Table for Computer Graphics System, Ser. No. 07/212,590 filed June 28, 1988;.

FIELD OF THE INVENTION

This invention relates generally to the field of computer graphics, and particularly to a technique for formatting and processing pixel data which makes efficient use of frame buffer and color table memory.

BACKGROUND OF THE INVENTION

A computer graphics workstation typically displays images on a raster scan cathode ray tube (CRT). These images are generated by an application program running on a data processor associated with the workstation. Such an image is typically represented by data values corresponding to the intensity or color of each elemental image area, called pixels. To cause the image to appear on the CRT, the pixel data values are first written into a frame buffer memory arranged as a two-dimensional array. The frame buffer memory is then repetitively and sequentially scanned by a refresh circuit so that the pixel data words are read out in synchronism with the CRT's horizontal and vertical refresh rate. The pixel data words are then fed to a digital-to-analog converter (DAC) and finally, in analog form, to the CRT's intensity control.

Since color CRTs have an intensity control for each of their blue, green, and red electron guns, pixel data words for such systems must actually include three data values, corresponding to the desired intensity value for each gun. A DAC must also normally be associated for each gun. The available number of colors thus depends on the range of allowable intensity levels, or number of bits per pixel data word. At present it is generally agreed that a twenty-four bit pixel data word having eight bits for each of the blue, green, and red intensity values provides a pleasing enough range.

Despite the ever-decreasing price of semiconductor memory, frame buffer memory is still relatively expensive, enough so that a workstation which stores the desired twenty-four bit pixel data words can become quite costly, especially if the CRT is to have spatial resolution on the order of a color television. Additionally, most applications do not require the use of all $2^{24}$ possible colors simultaneously. In many instances, then, the pixel data words are not directly fed to the DACs, but rather are used as addresses (i.e., an index) into a second memory called a color lookup table. The data output from the color table is then used to control the DACs. Usually the color table memory words are fairly long, twenty-four bits in the example being discussed, with the color tables' address space being fairly small, say 256 words. This allows each pixel data word in the frame buffer to be only eight bits wide, and yet the desired selection range of $2^{24}$ output colors is achieved. The price paid for this is that only 256 of the $2^{24}$ colors can be displayed simultaneously.

Even when a full twenty-four bit frame buffer (also referred to as a twenty-four plane frame buffer) is affordable, there are applications in which it is desirable to use something other than a one-to-one linear correspondence between pixel data words and the intensity inputs to the CRT. In these instances too, a color table memory can be indispensable.

The application program running on the associated data processor is normally responsible for originating the data in the color table memory. Unfortunately, the color table must be capable of being read out in a very short time, since a color table lookup operation is necessary for each pixel on each display cycle. For example, the color table read access time must normally be 25 nanoseconds or less for a $1000 \times 1000$ pixel image scanned at the usual 60 hertz frame rate. Effective use of the available color table memory is thus one key to maximizing graphics system performance.

While the foregoing arrangement is sufficient for its intended purpose, certain shortcomings become apparent as advances are made in the architecture of computer workstations. To being with, it is now common for workstations to use multi-tasking operating systems which allow several application programs to run simultaneously. Each application typically runs in its own dedicated area of the display or "window". It is desirable for a window to look like a complete graphics display to its associated application program. For example, in each application program, one would like to be able to specify a particular set of color table entries. Given the high required throughput rate, however, the color table must often be shared by multiple applications. This is due to the fact that semiconductor memory technology is simply not fast enough to allow rewriting of all entries in the color table in the time it takes for the refresh circuit to move from one window to the next, i.e. from one pixel data word to the next, since windows can be adjacent one another (and can even overlap). For the example discussed, this would require writing 256 entries in the 25 ns available between pixel data word readouts.

One solution to this problem would be to provide a separate hardware color table for each window and selectively enable the proper one as successive windows are scanned. However, this is not a particularly cost effective solution, and also places a hardware limitation on the number of windows displayable simultaneously.

While one normally thinks of an eight bit wide frame buffer as containing a single image with eight bits per pixel, it can also be thought of as containing two images, one with five bits per pixel and one with three bits per pixel, or as many as eight images with one bit per pixel, and so forth. Hence, corresponding bits of the pixel data words in the frame buffer memory have come to be referred to as bit planes, or simply planes, since each can be considered to hold a separate image. Thus in the example being discussed, one speaks of having an eight-plane frame buffer. The contents of the color table can then be written in such a way as to enable only one or more desired images at a time.

For example, consider how a bitonal image, such as a single-color grid, can be selectively displayed over a multiple color image. The multiple color image is written in the lower order planes of the frame buffer, e.g., the lower order seven planes in the exemplary eight plane frame buffer. The grid is written into only the high order plane, with logic ones written in the positions where, when the grid is enabled, the grid color is to show, and logic zeros written where the image is to show. To display the image and grid together, the 256-entry color table is written with the lower 128 entries (the ones addressed by the seven lower order bits when the high order bit is a zero) providing the desired colors for the multiple color image. The upper 128 entries (the ones addressed when the high order bit is a one) are all written with the single grid color. To make the grid "disappear", all that needs to be done is to re-write the upper 128 entries to correspond to the lower 128 entries used for the multiple-color image. To make the grid re-appear, the upper 128 entries can be re-written to all have the single grid color.

This approach to selectively displaying images is often useful in applications such as computer-aided design, where it is necessary for the user to select one particular object out of the many on the screen, or place grids over objects, or to display text data written in one plane together with graphic data written in another plane. A plane which can be selectively enabled in this fashion is referred to as an overlay plane. Efficient support of overlay planes is thus yet another reason for letting each application dictate the color table contents. However, implementing overlays in the manner described is not particularly efficient, since a single overlay plane requires using one-half the entries of the color table. If two overlay planes are needed, three-quarters of the color table are used up, and so forth. One solution to the overlay/color table problem is to have a dedicated overlay register which is enabled by a bit in the pixel data word. However, the overlay register tends to become another resource contended for by several applications at once, and also does not eliminate the problem of having each application program control the way in which the planes of the frame buffer address the entries in the color table.

An even worse situation occurs if an object "pick" or "select" feature is desired. With such a feature, an object or a particular area of the screen is selected for further operations. The selected object or area can be so indicated by making it appear brighter. Thus, twice as many entries must be used in the color table, a dim entry and a bright entry for each color. However, the required number of bit planes in the frame buffer is increased by three, since one bit for each color must be added to indicate when it is to appear bright or dim.

Animation techniques such as double buffering also place a heavy burden on the color table. If the application does not justify the cost of two complete frame buffers, the typical approach to double buffering is to split the frame buffer in half. Thus, with an eight plane frame buffer can be used to provide two four plane frame buffers. However this leaves only four planes in each buffer, each of which can select only one of sixteen possible colors. Thus, all 256 entries in the color table must be used, even though only sixteen colors can actually be displayed simultaneously.

To support such features as overlay planes and double buffering, some systems use a mask register to specify which planes are to be enabled at a given time. The contents of the mask register are logically ANDed with each pixel word to select the desired active planes before passing them to the color table address inputs. It is also sometimes necessary, especially for double buffering, to specify a shift of the masked bits word bits to place them in the proper position. A cross-bar switch can be used which allows to allow routing of any bit plane to any color table address input position. However, cross-bar switches tend to require a large number of control inputs (at least N log N where N is the number of bits in the cross-bar switch), and thus in most instances, it is not possible to design one which is reconfigurable at the pixel data word rate without requiring a large number of control planes. Such a cross-bar switch thus tends to become, in most practical systems, yet another resource which must be shared among applications.

Another problem with supporting windows is the often-executed function of clearing the screen. Since it is desirable for a clear operation to occur as quickly as possible, certain semiconductor memory chips designed for use as frame buffers include a built-in flash clear function. The flash clear function can directly clear many bits of the memory chip in a single write cycle, without having to write to all of the addresses sequentially. However, it is often the case that flash clear cannot be directly used to clear windows, since windows have arbitrary boundaries determined by the application program which do not necessarily align with the memory chip organization. Typically, such chips are arranged so that flash clear can only clear an entire row of pixels, or a group of pixels that is a power of two in length. Thus a flash clear operation performed in one memory chip would possibly clear the area occupied by two or more windows. One way to solve this problem is to use one of the bit planes as a so-called valid plane. Rather than clear all planes, just the valid plane is enabled to be cleared by the application program. The valid plane bit is then logically ANDed with another input which is true only when the frame buffer address is inside the particular window. In this fashion, the window can be quickly cleared, but at the price of a plane. When the frame buffer inside the window is written at a particular position, the valid plane is disabled at that location, and the pixel data is allowed to pass through to the color table. However, the use of valid plane clearing is exacerbated in a multiple window environment, where each window normally wishes to specify its own background color to distinguish it from other windows.

SUMMARY OF THE INVENTION

In brief summary, a computer graphics system constructed in accordance with the invention includes a pixel map unit which operates on an input pixel data word and an input mapping configuration word. The mapping configuration word is used to specify the format of the pixel data word. Depending on the format, operations such as rotation, masking, overlay and addition to a base register are performed to provide an output which is used as an address to index a color table memory. The mapping configuration word is independent of the pixel data word, so that in the typical application, a different mapping configuration word can be associated with each of a plurality of windows. The mapping configuration words for a number of windows can be stored in a random access mapping memory which is addressed by the current window number.

The mapping configuration words selectively provide a number of pixel word interpretation modes. For example, a mask and a number of shift positions are specified in the mapping configuration word, so that a color channel intensity value or values can be selected from various contiguous groups of bits in the pixel data word. Additionally, either a linear, pseudocolor mode or a direct, full color mode can be selected. In pseudocolor mode, the same color table address is generated for each color channel. In full color mode, a unique address is specified for each channel.

Also, certain frame buffer planes may be specified to provide an overlay value in either mode. In pseudocolor mode, the overlay value bits are taken from the planes adjacent the highest order one of the enabled frame buffer planes, as indicated by the mask and number of planes specified in the mapping configuration word. The overlay value is then subtracted from a prestored color table base address to arrive at the final output color table address.

When full color mode is enabled, a bank select feature allows selected predetermined overlay value bits to be interpreted as a bank number. This bank number is then concatenated with each of the three unique pixel data values to provide a color table address for the three channels.

Another mode interprets a selected pixel word bit as a bitonal specifier. This can then be used to select any two of the available color table entries. A shift and mask field select a single bit which in turn is used to select either a foreground or background color table index. The foreground and background indices are preloaded as part of the mapping configuration word for a given window.

Additionally, a list of background colors, one for each window, can be stored contiguously in the color table. If a valid enable bit in the mapping configuration word is set, a particular bit plane is monitored. If the logical AND of these two inputs is false, the mapping operates normally. If it is true, the input mapping select or window number is used as an index into the list of background colors.

There are several advantages to this invention. Each application program is allowed to specify how the planes of its own area in the frame buffer are interpreted by the color table. This not only eliminates the need to use separate color tables for each window in many applications, but also provides many of the same features as would be provided if each window had its own lookup.

The overlay value feature can be used to reduce the number of color map entries needed to achieve a particular result. For example, the overlay value can be enabled to select either entries in the standard color table or one of several possible overlay colors located in the address space immediately before the base address of the standard color table entries. Because a base address can be specified depending upon window number, competition between applications for the overlay space is eliminated, and there is no need for duplicate entries in the color table.

Pseudocolor mode can be used to efficiently support multiple overlays and double buffering. In particular, because the position of the overlay value bits depends on the specified number of enabled planes for the particular image being displayed, multiple windows can use disjoint sets of overlay bits. Also, if it is required that two windows overlap on the screen, and there is enough frame buffer memory to store both images, the window visible in the overlapping space can be selected by simply changing the pixel mapping, rather than by redrawing the image in the frame buffer, as was previously necessary.

In full color mode, the use of fixed overlay value bit positions to specify a bank number used for each of the three color table allows the color tables to appear either as multiple dedicated color tables or a single, larger color tables, under control of the applications software. Most importantly, this is done using the same frame buffer planes to specify a bank number for each color table, which minimizes the number of frame buffer planes needed.

The bitonal mode allows any bit of the frame buffer to select any two colors already stored in the color table, eliminating the need to rewrite a desired background color into address zero of the color table.

The valid plane mode can be used to quickly clear a window to its assigned background color.

BRIEF DESCRIPTION OF THE DRAWINGS

This invention is pointed out with particularity in the appended claims. The above and further features and advantages of the invention may be better understood by referring to the following description and the accompanying drawings, in which:

FIGS. 4A and 4B, respectively, describe a full color operation of the pixel map unit and the results;

FIGS. 6A and 6B, respectively, describe a bank select operation and the results.

DETAILED DESCRIPTION OF ILLUSTRATIVE EMBODIMENTS

Figure 1:
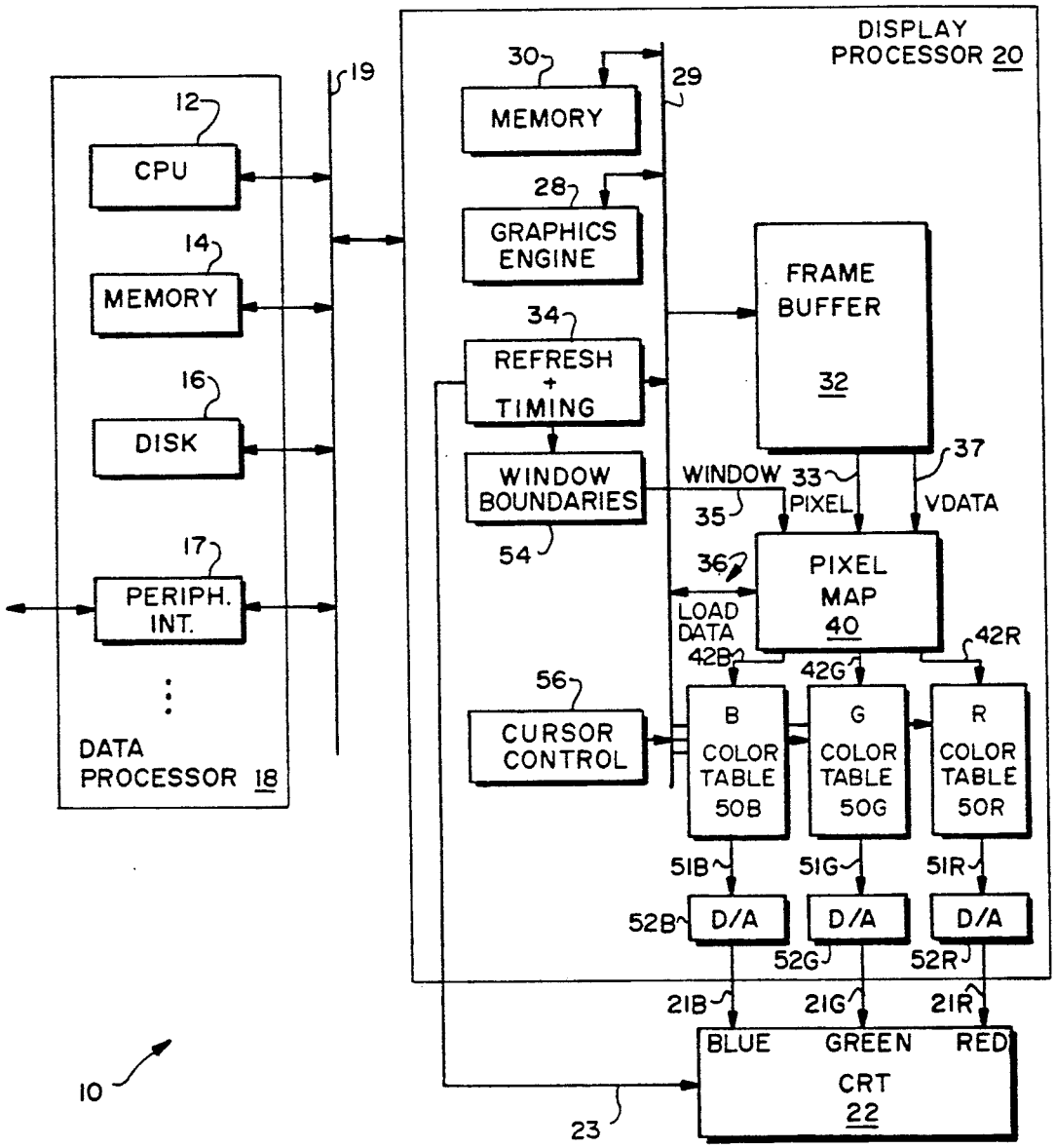
FIG. 1 is a block diagram of a graphics workstation including a frame buffer, pixel map unit, and color tables constructed in accordance with the invention.

Referring now in particular to FIG. 1, there is shown a computer graphics workstation 10 including a data processor 18, display processor 20 and cathode tube (CRT) 22. The data processor 18 is a conventional digital computer including a central processing unit (CPU) 12, memory 14, disk 16, and peripheral interface 17 interconnected by a data processor bus 19. Applications program software executed by the data processor 18 in turn issues commands to the display processor 20 over the bus 19. As a result, the display processor 20 causes text and graphic images to appear on the CRT 22.

The display processor 20 includes a graphics engine 28, general purpose memory 30, frame buffer memory 32, refresh and timing circuit 34, pixel map unit 40, color table memories 50B, 50G and 50R, and digital-to-analog converters 52B, 52G, and 52R. The display processor 20 may also include a window number generator 54 and a cursor control circuit 56. The graphics engine 28, memory 30, frame buffer 32, refresh and timing circuit 34, frame buffer 32, color tables 50, window number generator 54, and cursor control 56 are interconnected via a display processor bus 29.

A color table memory 50B and digital-to-analog converter (DAC) 52B are used to provide a blue intensity channel input 21B to the CRT 22. Similarly, color table 50R and DAC 52R generate the green intensity channel 21G, and color table 50R and DAC 52R generate the red intensity channel 21R. In the following discussion, components required for each of the blue, green and red channels are referred to by reference numerals appended with "R" "G" or "B" as appropriate; and sometimes all three of such components are collectively referred to by the corresponding reference numeral alone.

In operation, briefly, the graphics engine 28 interprets commands received from the data processor 18 thus causing pixel data words 33 to be written into the frame buffer 32. The pixel data words 33 are then sequentially read out of the frame buffer 32 by the refresh and timing circuit 34. To generate the appropriate analog signals for each of the blue, green, and red intensity inputs 21 of the CRT 22, the pixel data words 33 are operated on in sequence by the pixel map unit 40, the color tables 50B, 50G and 50R, and the DACs 52B, 52R and 52G.

It is the function of the pixel map unit 40 to determine just how the three intensity inputs 21 are constructed from the pixel data word 33. In particular, the pixel map unit 40 selects which planes from the frame buffer 32 are to be fed to which inputs of the color tables 50. Thus, bits or groups of bits of each pixel data word 33 are selected in accordance with an mapping configuration word dependent upon the window number 35 to construct a mapped output 42 for each of the three color channels. The mapped outputs 42B, 42G, and 42R are then used as an address by a respective one of the color tables 50B, 50G, and 50R. The pixel map unit 40 also permits a window number dependent address to be added to the pixel data output from the frame buffer 32, so that the color tables 50 can be arbitrarily partitioned. Such arbitrary partitioning allows the use of color table entries not used by one window to be used by another window, such as may occur if one window is using the color table to support double buffering, and another window is not.

The refresh and timing circuit 34 generates necessary synchronization signals to coordinate the transfer of pixel data between the components of the display processor 20 as well as the transfer of data between the frame buffer 32 and the CRT 22. In particular, refresh circuit 34 operates in a conventional fashion to scan the contents of the frame buffer 32 in sequential order, thereby causing the frame buffer 32 to output pixel data 33. The refresh circuit 34 also directly controls the horizontal and vertical timing inputs 23 on the CRT 22, so that each pixel data word is displayed in the proper (x,y) position on the face of the CRT 22.

Certain registers and memories in the pixel map unit 40 can be prewritten via a load data bus 36 during times when pixel data is not being processed, such as during the vertical or horizontal retrace time of the CRT 22.

The window number 35 is typically dependent upon the present state of the horizontal and vertical refresh cycle; that is, it depends on the present (x,y) position of the electron guns of the CRT 22. The window number can be set by the graphics engine 28 or preferably is generated by a window number generator 54. A typical window number generator 54 uses programmable registers to define the boundaries of each window on the display. The window boundary registers are continuously compared to the current position to determine the current window number 35. Depending upon the design of the display system, the cursor control 56 may also have direct access to the color tables 50 or the frame buffer 32. Reference can be had to a copending United States patent application, entitled "APPARATUS AND METHOD FOR SPECIFYING WINDOWS WITH PRIORITY ORDERED RECTANGLES IN A COMPUTER VIDEO GRAPHICS SYSTEM", Ser. No. 07/205,030, filed June 13, 1988, and assigned to the same assignee as this application, for detail of one embodiment of the window number generator 54 and cursor control 56.

By specifying the window number 35 together with each pixel data value 33 to the pixel map 40, the addresses input into the color table 50 by the pixel map 40 can be modified in accordance with both the window number 35 and the pixel data value 33 in real time. Thus, each application can specify how the entries in the color table 50 are to be used.

Figure 2:
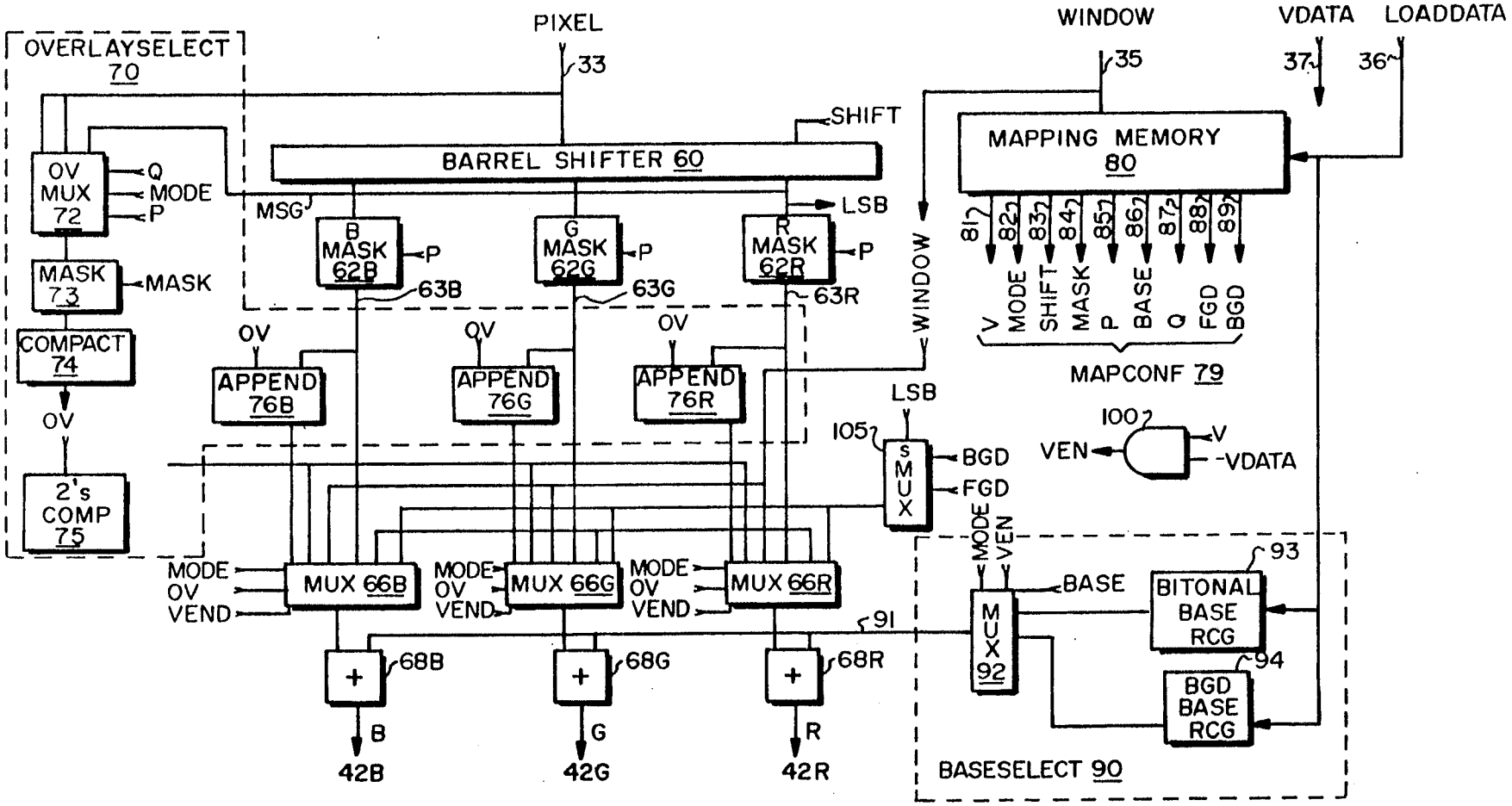
FIG. 2 is a schematic diagram showing the pixel map unit in greater detail.

Referring now to FIG. 2, the operation of the pixel map unit 40 may be better understood. The pixel map 40 includes a barrel shifter 60, pixel mask 62, pixel multiplexer 66, adder 68, overlay select 70, mapping memory 80, and base address selector 90. Generally speaking, the barrel shifter 60, pixel mask 62, pixel multiplexer 66, adder 68 and overlay select 70 operate on the pixel data 33 provided from the frame buffer 32. The operations are in accordance with instructions provided by the mapping memory 80. The mapping memory is responsive to the window number 35. Thus, the pixel data 33 is subject to shifting, masking, selecting and other arithmetic and logical operations dependent upon the window number 35.

As shown, the mapping memory 80 provides various control signal outputs for a given input window number 35. The output of mapping memory 80 called a mapping configuration word 79, contains several fields at a minimum. The fields are called valid plane field (V) 81, mode 82, shift 83, mask 84, planes (p) 85, base address (BASE) 86, overlay select (Q) 87, foreground address (FGD) 88, and background address (BGD) 89.

The mode field 82 is a primarily an instruction which indicates the operation to be performed on the pixel data 33. The valid plane field 81 specifies whether valid plane mode is enabled, and thus is also an instruction in a sense. The shift 83 field is used to specify the number of bit positions which the the pixel data 33 is to be shifted to the right. The mask field 84 is used by overlay select 70 to select, mask and compact the overlay bits as will be described. The P field 85 indicates the number of active planes, or bits per pixel. In pseudocolor mode, the P field 85 indicates the total number of active planes; in full color mode, the P field 85 indicates the number of active planes for each of the blue, green and red channels. In either mode, the P field 85 is used as an input by the pixel masks 62 to enable only the desired planes. The base field 86 is typically used as a base address to which the results of the operation of the multiplexers 66 are added. The Q field 87 is used by the overlay select logic 70 to determine which bits of input pixel data 33 are selected. Finally, the foreground background fields 88 and 89 are used by the background/foreground multiplexer 105 and pixel multiplexers 66 as an additional path to pass a base address to the adders 68.

The contents of the mapping memory 80 are written via the load data bus 36 whenever the pixel map unit 40 is not processing pixel data 33, such as during the vertical or horizontal refresh time of the CRT 22. Its contents may be written by the graphics engine 28, or directly by the memory 30 if the hardware supports direct memory access, or in other suitable ways which depend upon the architecture of the workstation 10.

In operation, pixel data 33 is first fed to the barrel shifter 60. The window number 35 is fed to the address inputs of the mapping memory 80, which in turn causes the mapping configuration word 79 associated with that window number 35 to appear at its outputs. In response to the shift field 83 in the mapping configuration word 79, the barrel shifter 60 causes the pixel data 33 to be shifted the indicated number of bits to the right. The shifted pixel data is in turn passed to the pixel masks 62B, 62G, and 62R as three groups of bits, one group for each of the red, green and blue channels. In pseudocolor mode, the group of bits for each channel is identical; in full color mode, each channel receives unique ones of the pixel data bits. The pixel masks 62 perform a data masking operation in accordance with the number of planes indicated by the P field 84 in the mapping configuration word 79. For example, if the indicated number of planes is three, each of the pixel masks 62B, 62G and 62R perform a masking or logical ANDing to select only the three lower order bits of each group. The outputs 63 of the pixel masks 62 contain the masked and shifted intensity value for each channel.

The intensity values in turn are passed to corresponding ones of the pixel multiplexers 66B, 66G and 66R. The pixel multiplexers 66 each select a data source, primarily in accordance with the mode field 82. The operation of the pixel multiplexer 66 may also be affected by the results from the overlay select 70 or the valid plane enable logic 100, as will be described shortly. The resulting outputs from the pixel multiplexers 66 are fed to corresponding ones of the three adders 68B, 68G and 68R. The adders 68 each add a base address to the pixel multiplexer outputs. The base address may come from the mapping configuration word 79 BASE field 86 or other registers as explained below. The outputs of the three adders 68B, 68G, and 68R provide the final mapped outputs 42B, 42G, and 42R which are then used as address inputs to the color table memories 50B, 50G, 50R (FIG. 1).

As FIG. 2 also indicates, the overlay select, unit 70 includes an overlay multiplexer 72, overlay mask 73, overlay compactor 74, an overlay two's complement 75, and appenders 76. The overlay multiplexer 72 selects certain bits from either the pixel data 33 or the outputs from the barrel shifter 60 in accordance with the mapping configuration word 79; specifically, the mode 82, P 85, and Q 87 fields. The overlay mask 73 masks the bits selected by the overlay multiplexer 72 in accordance with the mask field 84. These bits are in turn compacted in the overlay compactor 74. Compactor 74 compacts the output of the overlay mask 73 by removing the bits not selected by the logic true bits of the mask field 84. The selected bits are then compacted or concatenated. This provides an overlay value output OV which is fed to control additional portions of the pixel map unit 40, particularly the appends 76 and pixel multiplexers 66. The overlay value OV is also fed to an overlay two's complement 75 which causes the two's complement of the overlay value OV to be sent to each of the pixel multiplexers 66. The appenders 76B, 76G, and 76R each accept the overlay valve bits OV and one of the outputs of the masks 63B, 63G, and 63R to provide another input to a corresponding one of the multiplexers 66B, 66G, and 66R, this input being the overlay valve bits (OV) with the shifted and masked intensity value appended.

Another input for each of the pixel multiplexers 66 comes from a background/foreground multiplexer 105. The background/foreground multiplexer 105 selects one of the foreground 88 or background 89 fields from the mapping configuration word 79 in accordance with the least significant bit (LSB) of the output of the barrel shifter 60.

The base address select 90 includes a base address multiplexer 92, bitonal base register 93 and background base register 94. The base address multiplexer 92 selects either the base field 86, the output of bitonal base register 93, or the output of the background base register 94 in accordance with the select which are, in turn, controlled by the mode field 82 and virtual plane enable signal VEN output from the virtual plan enable logic 100 The bitonal base register 93 and background base register 94 are preloaded via the load data bus 36 prior to the operation of the pixel map 40 and on pixel data 33. The output of the base address multiplexer 92 is fed along a base address output line 91 to each of the adders 68.

The pixel map unit 40 of FIG. 2 is capable of performing several different types of mapping operations. The first operation is a linear mapping to provide a pseudocolor mode. In this mode the same address is sent to each one of the color tables 50.

A second mode, referred to as a direct mapping or full color mode, provides full color mapping, wherein a different address is sent to each color table 50. For example, in an eight plane system, the eight bits from the frame buffer can provide three different sets of eight bit-wide mapped outputs 42R, 42G, and 42R.

In either of these modes, certain bits from the pixel data 33 can be used as overlay planes. When in pseudocolor mode, the overlay planes are interpreted as an overlay value. The overlay value is used as an address to select one of several oVerlay colors stored in the color tables 50. For example, if the overlay value is zero, they have no effect on the mapped outputs 42. If the overlay value is non-zero, it is subtracted from the base address 91 to specify an index into a separate overlay color space which is immediately adjacent (i.e. before) the direct address space in the color tables 50. Overlays generated in this fashion can be especially useful in implementing functions such as writing text over graphics, rubber band lines, or double buffering. This is because entries in the color table itself are indexed by the overlay values, eliminating the need for special overlay registers. By having the overlay values addressed by subtracting them from a base address, a large portion of the color table 50 can be conserved, as one need not to use up one-half the remaining address space to implement an overlay plane—only a single color table 50 entry is used. By allowing the application to also specify an overlay mask 73, the selective display of multiple overlay planes can be efficiently implemented.

In the pseudocolor mode, the bits forming the overlay value are preferably taken from the planes adjacent the highest order plane still enabled after masking. In this instance, the position of the overlay bits thus depends on the specified number of enabled planes for the particular image being displayed, and are not constrained to be in a particular plane. This allows multiple windows to use disjoint sets of overlay planes, so to have if it is required that two windows overlap on the screen, and there is enough frame buffer memory 32 to store both images, the window visible in the overlapping space can be selected by simply changing the pixel mapping. Otherwise, the frame buffer would have to be redrawn.

When in full color mode, the overlay value OV is used as a bank select, that is, it is appended to the most significant bits of the intensity values. This is a convenient way to specify which of a plurality of contiguous spaces in the color table 50 are to be selected, as is needed when supporting an object select feature, for example. In this mode, if the frame buffer 32 is sufficiently large, the overlay bits can be taken from dedicated overlay planes. If this is not cost efficient for the particular application, the overlay bits can be selected from the low order bits of each channel intensity value, as needed. Since blue color differences are the most difficult to perceive, the blue channel intensity bits can usually be sacrificed first—so that the least significant overlay bit, which is the most often used, is preferably taken from the blue channel least significant bit. Overlay bits are then taken from the least significant green channel, least significant red channel, second least significant blue channel, and so forth. The selection of overlay bits from the planes normally available only for storing intensity values can minimize the number of planes needed to accomplish a desired result. It can also be used provide overlay functionality in a system which was not originally designed to support it, since the overlay planes are in effect "stolen" from the channel intensity planes.

By appending the overlay bits to each of the three intensity values for the three channels, fewer bit planes are used than would be required if each channel has to specify its own bank select bits.

Another mode allows any bit of the pixel data word 33 to selecting one of any two colors in the color tables 50. If enabled, the least significant bit of the output of the barrel shift 60 is used to select one of the foreground and background address specified by the FGD 88 and BGD 89 fields. For example, if the least significant bit is zero, then the background address selected, and if it is a one, then the foreground address is selected by the background/foreground multiplexer 105. The BGD and FGD fields 88 and 89 are specified by the window number input to the mapping memory 80. The results of the selecting operation are then added to the contents of a bitonal base register 93. This operation allow the selection of any two colors in the color tables 50 with a single plane.

A final mode supports the use of a valid plane. This valid plane feature is provided for by using one plane of the frame buffer 32 to indicate whether the rest of that pixel data 33 is valid or not. If the valid plane operation is enabled, and if the valid plane bit indicates that a particular pixel data value is invalid, a window dependent background color index is substituted for the pixel data value. This feature is implemented in the pixel map unit 40 by the V field 81, which is logically ANDed to the VDATA input 37 by the gate 100. The VDATA 37 is preferably taken from one of the bits planes in the frame buffer 32. The result, VEN, is used to selectively enable the corresponding window dependent background color address. This is accomplished by having the contents of the background base register 94 and the window number input 35 passed to each of the adders 68.

The operation of these various modes can be better understood by referring to FIGS. 3A through 7B. The variable names used in FIGS. 3A, 4A, 5A, 6A and 7A correspond to the data and field names of FIGS. 1 and 2. For example "MODE" is the mode field 82, "PIXEL" is the pixel data 33, and "B" corresponds to the blue channel mapped output 42B. Also, the notation (PIXEL >> SHIFT) indicates the operation of the barrel shifter 60, which shifts the value of PIXEL to the right by the number of bit positions indicated by the value of SHIFT. The notation {X} COMPACTED means to select the bits of "X" indicated by the value of MASK, and remove the unwanted bits, i.e. the operation preformed by the compactor 74. The operation X<a:b> indicates the operation of selecting the bits in positions "a" through "b" of the variable "X", with bit positions integrally numbered from 0 to r-1, where 0 is assigned to the least significant bit position and r is the number of bits in the variable. The PIXEL variable is assumed to be 28 bits long in the examples shown, with the 24 low order bits devoted to providing up to eights bits each for the red, green, and blue intensity values, and the high order four bits to indicate overlay planes when in full color mode. In pseudocolor mode, of course, all 28 planes are available to specify intensity values, as the overlay planes are not necessarily fixed to be the high order four bits.

Figures 3A, 3B:
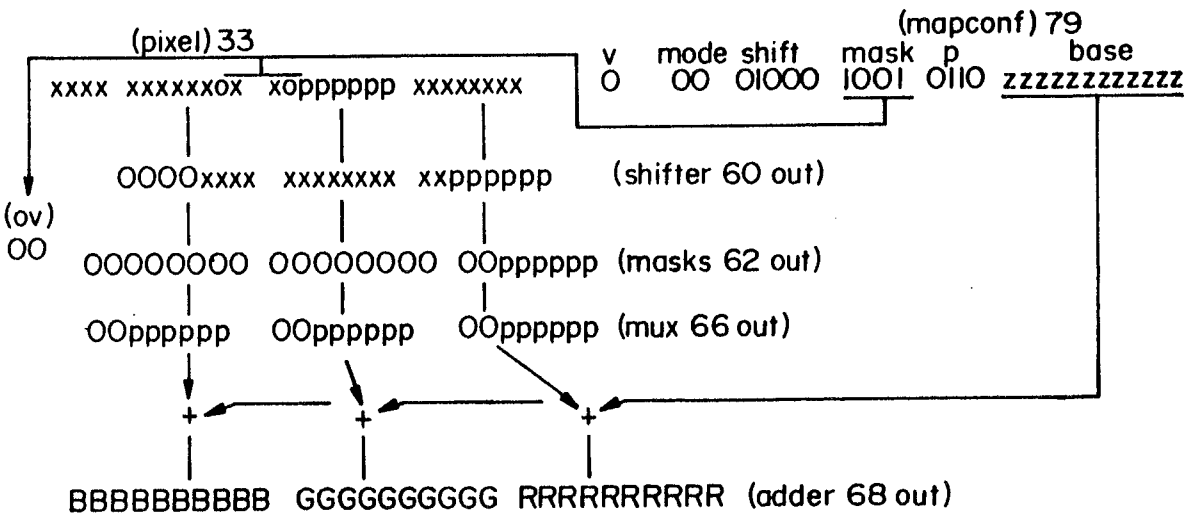
FIG. 3A describes a pseudocolor mode of operation of the pixel map unit as a sequence of operations.
FIG. 3B shows the results of the operations performed in FIG. 3A on exemplary input pixel data when overlay mode is not enabled.

The sequence of operations performed by the pixel map unit 40 in linear mode is shown in FIG. 3A. The operations listed could also be carried out by any suitably arranged computer of a more general organization, and thus it is not necessarily required that they be performed by the special hardware of FIG. 2.

Now, more particularly if linear mapping is selected, as specified by the mode equalling 00b (zero binary), the process begins by logically ANDing the four lower order bits of the MASK with the overlay bits. The overlay bits are formed by shifting PIXEL right the number of planes indicated by SHIFT and then selecting the four bits at positions P+3 through P, where P is the number of planes reserved for pixel data. If the results of the ANDing are false (i.e., equal 0) the red, green and blue mapped outputs R, G, and B are each set to bits P-1 though 0 of the shifted PIXEL data plus the BASE. Otherwise, the R, G, and B are set to the BASE minus the compacted overlay bits.

The results of the operations of FIG. 3A on exemplary input data are shown in the data flow graph of FIG. 3B. The 28 bits of input pixel data 33 are "xxxx xxxxxxox xopppppp xxxxxxxx"

and 28 bits of mapping configuration word 79 are

"0 00 01000 i001 0110 zzzz zzzz zzzz"

In interpreting this flow graph, bits labeled "x" are don't cares, "1" and "0" mean logic one and zero, "o" indicates bits which are used as overlay bits, "r", "g", "b" and "p" indicate bits used to construct the intensity values, and "f" and "b" indicate base address bits. The fields of the mapping configuration word are indicated above the bit groupings. In considering the discussion of the flow graph, it is also helpful to consult FIG. 2.

The first operation is to the shift the input pixel word 33 by the indicated the number of shift bits, which is "01000" or 8. Thus, the barrel shifter 60 outputs an eight bit shifted right pixel word, as shown next to the (shifter 60 out) indication. The desired intensity bits "pppppp" are thus shifted into the right most six bit positions. The overlay multiplexer 72 (FIG. 2) picks out the four bits to the immediate left of the desired pixel bits, indicated in FIG. 3B as "oxxo". The mask "1001" is logically ANDed to the four overlay bits, with a "1" bit in the mask indicating a desired overlay bit. The result is then compacted by selecting the desired bits of the mask, here the high order bit and the low order bit. The result of this compacting is "00", so the overlay mode is disabled, and the overlay bits are not used any further. The shifted pixel value from the barrel shifter 60 is ANDed with the mask indicated by the planes field "P". Here P indicates 6 planes, so the pixel mask used is "00111111". The result of the masking operation; indicated to the left of (mask 62 out), is to have the lower order eight bits, or red channel, equal to "00pppppp" and the blue and green channels set to zeros. In this mode the red channel is enabled at the output of all the multiplexers 66, so that each one outputs "00pppppp". These multiplexer outputs 66 (mux 66 out) are then added to the base address "zzzzzzzzzzzz" output from the base address multiplexer 92 (which is appropriately enabled by the mode input) to complete the operation.

Figure 3C:
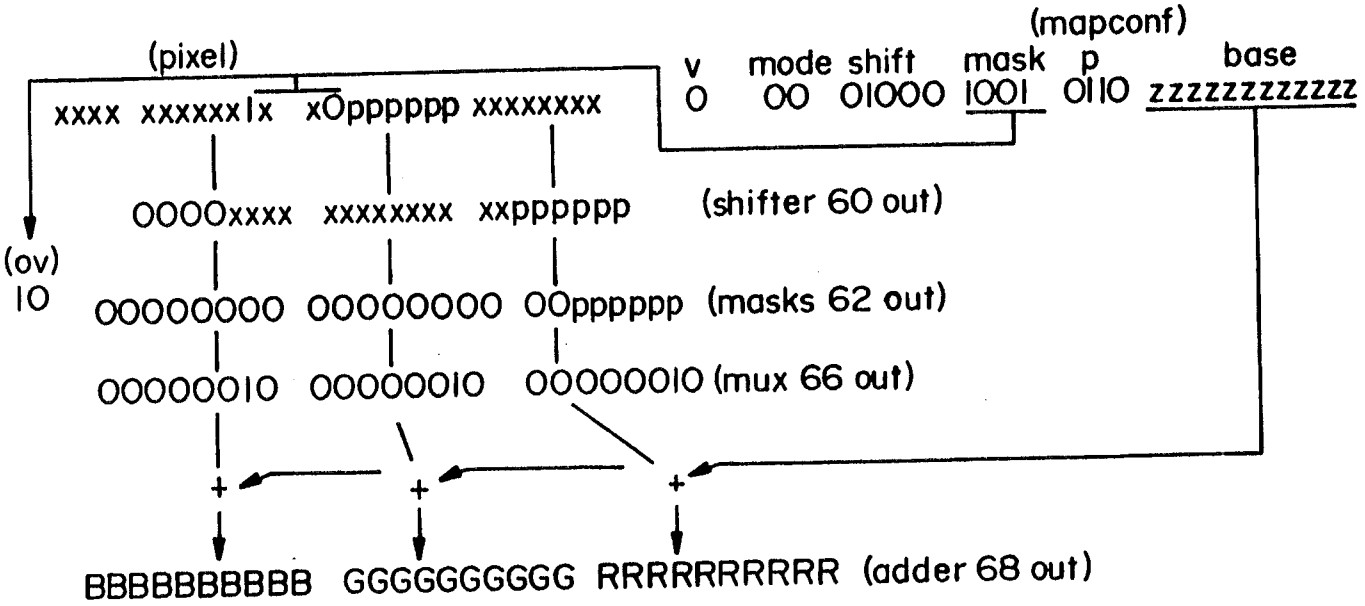
FIG. 3C shows the results of the operations performed in FIG. 3A on exemplary input pixel data when overlay mode is enabled.

FIG. 3C differs from FIG. 3B in that on overlay value is specified. This is because the result of logically ANDing the bits of the mask with the four overlay bits is "1xxO", which becomes "10" after compacting. The mapped outputs are generated by subtracting the overlay value from the base address, so that in the example shown, the address pointed to for all three channels is the base address minus two.

Figure 4B:
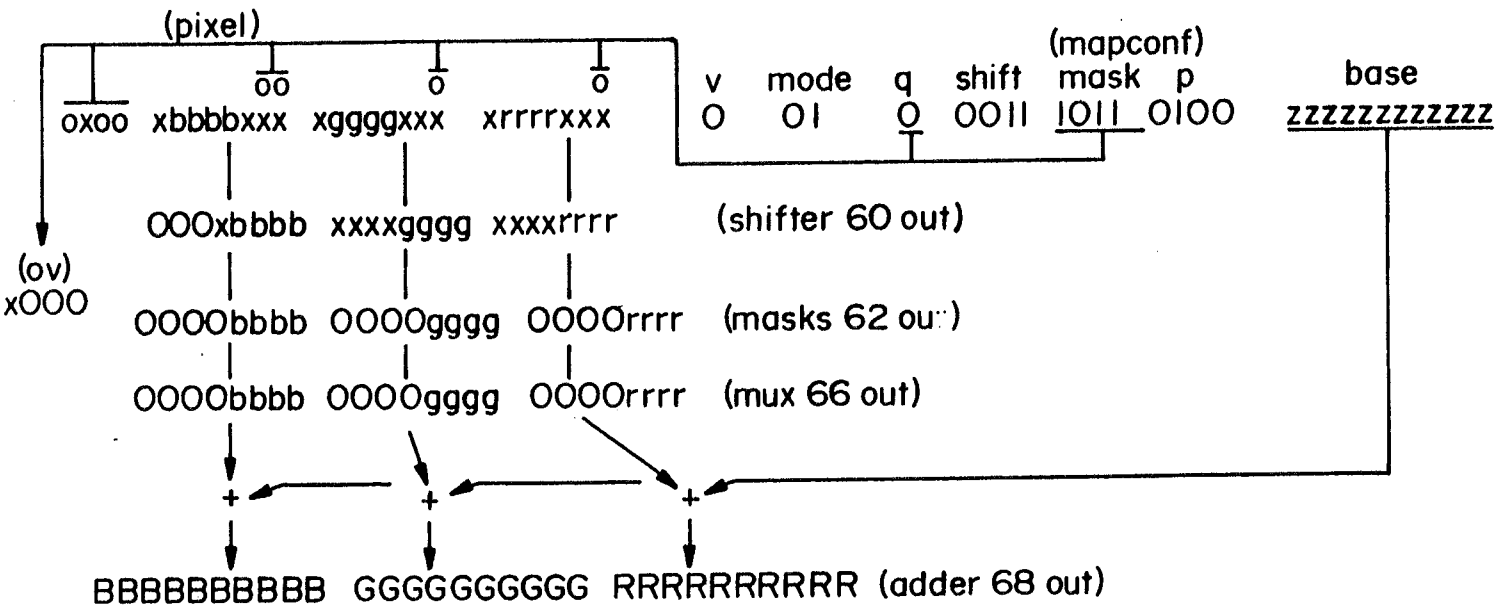

Similarly, FIGS. 4A and 4B respectively list the sequence of steps and data flow graph for the operation of the pixel map unit 40 in a direct map, full color mode. It is seen that for this mode the overlay bits are taken from one of two fixed positions in the pixel data word 33, depending, upon the value of the Q field. If Q is zero, then the overlay bits are taken from bits 27 through 24 of PIXEL; else they are selected from the low order bits (bit numbers 16, 8, and 0) of each channel and finally from the second lowest order bit of the blue channel (bit number 17), as needed. As previously mentioned, the blue channel bits can usually be sacrificed first—this is indicated by taking the least significant overlay bit, OV<0>, which is the most often used, from the blue channel least significant bit (bit <16> of PIXEL).

Continuing with FIG. 4A, it is seen that in full color mode, the overlay bits are again masked and compacted and tested for zero as for pseudocolor mode. If the masked and compacted overlay bits are not set to zero, they are two's complemented and sent each of the three channels, where they are subtracted from the BASE. In this fashion, they can be used to select entries in the color table located immediately before the direct mode color table. beginning at the BASE address. For example, if there are two bit planes available for overlay, the base address and to the three entries immediately before the base address can be selected in each of the color tables. If the result of masking the overlay bits by the overlay multiplexer 72, overlay mask 73 and overlay compact 74 is a zero, then the blue, green and red mapped intensities B, G, and R are generated by simply adding the base value to the corresponding masked intensity value for each channel.

The signal flow graph of FIG. 4B shows the result of the operations of the pixel map unit 40 in direct map mode. The shifting (here (3 bits right) and masking (here the low order four planes) operation of the barrel shifters 60 and pixel masks 62 provide three different intensity values "bbbb", "gggg" and "rrrr" for each of the blue, green or red channels, respectively. Also, here the Q field is set to zero, so that the overlay value is selected from the high order four bits of the pixel input 33 rather than the two lower order bits of the blue channel or lowest order red and green channel bits. Since the overlay field (OV) is zero, the mapped outputs B, G, and R are constructed by adding the respective outputs of the multiplexers 66 (mux 66 out) to the base address specified in the base field 86.

Figures 5A, 5B:
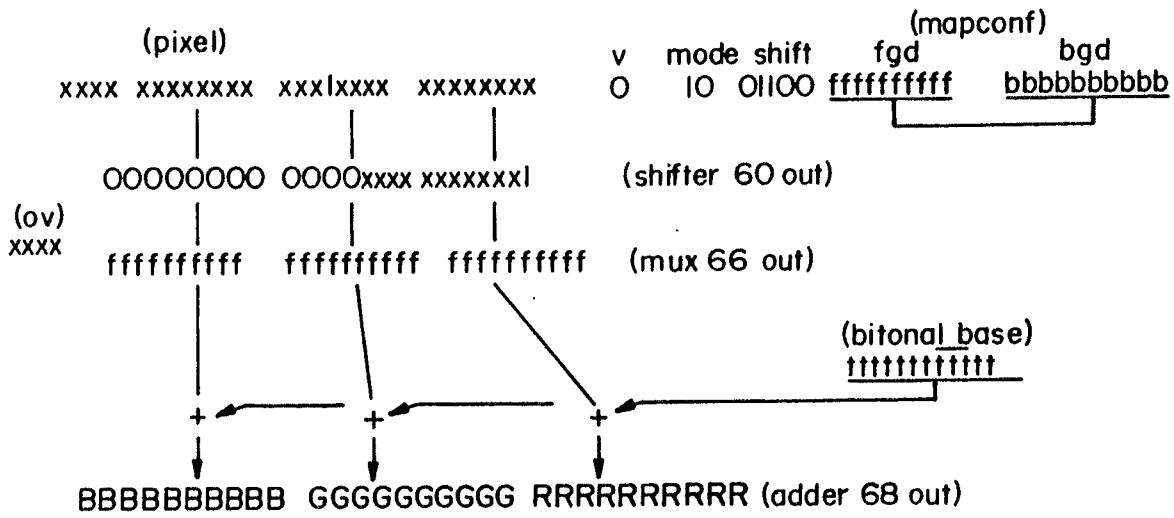
FIGS. 5A and 5B, respectively, describe a bitonal operation and the results.

FIGS. 5A and 5B, respectively, show the operations and a signal flow graph of the bitonal mode. In this mode, which is specified by mode field equalling "10", the least significant bit (bit <0>) of the shifted PIXEL is tested. If it is set to zero then the BGD field 89 is added to a bitonal base value to obtain each of the B, G, and R values. Otherwise, the FGD field is added to the bitonal base value. The signal flow graph of FIG. 5B shows the results of shifting right, 12 bits, as specified by the shift field, and as shown adjacent to the the (shifter 60 out) designation. The pixel multiplexers 66 are controlled by the least significant bit of the shifter output to select either the FGD or BGD field. Since here the least significant bit is a "1", the FGD field "ffffffffffff" is passed to the adders where it is in turn added to the contents of the bitonal base register, "tttttttttttt".

Figure 6B:
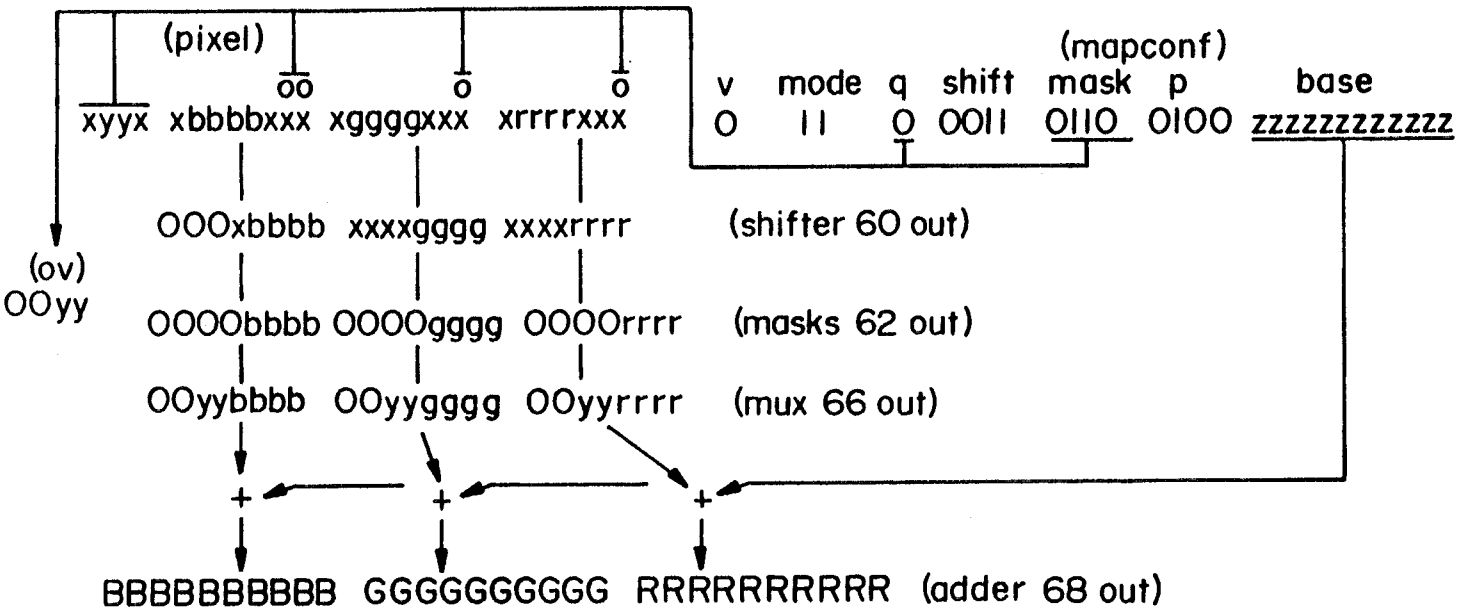

FIGS. 6A and 6B describe the direct mapping mode with bank select enabled. As before, the number of direct mapped planes is determine by the P field. Selection of the overlay bits occurs as for the standard direct mapped mode shown in FIGS. 4A and 4B—however, the overlay bits are used as a bank index to select one of 2N possible banks (or contiguous portions of color tables memory), where N equals the number of overlay bits. Referring to FIG. 5B, the shifted and masked pixel input is used to provide bits "bbbb", "gggg", and "rrrr" to a respective one of the red channel, green channel and blue channel. The bank select bits (here set to "yy") are appended to the left of each of these by the multiplexers (mux 66 out). Thus, in the illustrated example, there are two overlay bits "yy" which are the same for each color channel and four lower order bits which are unique for each channel. So, if the bank select bits indicate zero, the first set of 16 colors will be address in each color table, and if set to one, the next 16 will be selected, and so forth.

Figures 7A, 7B:
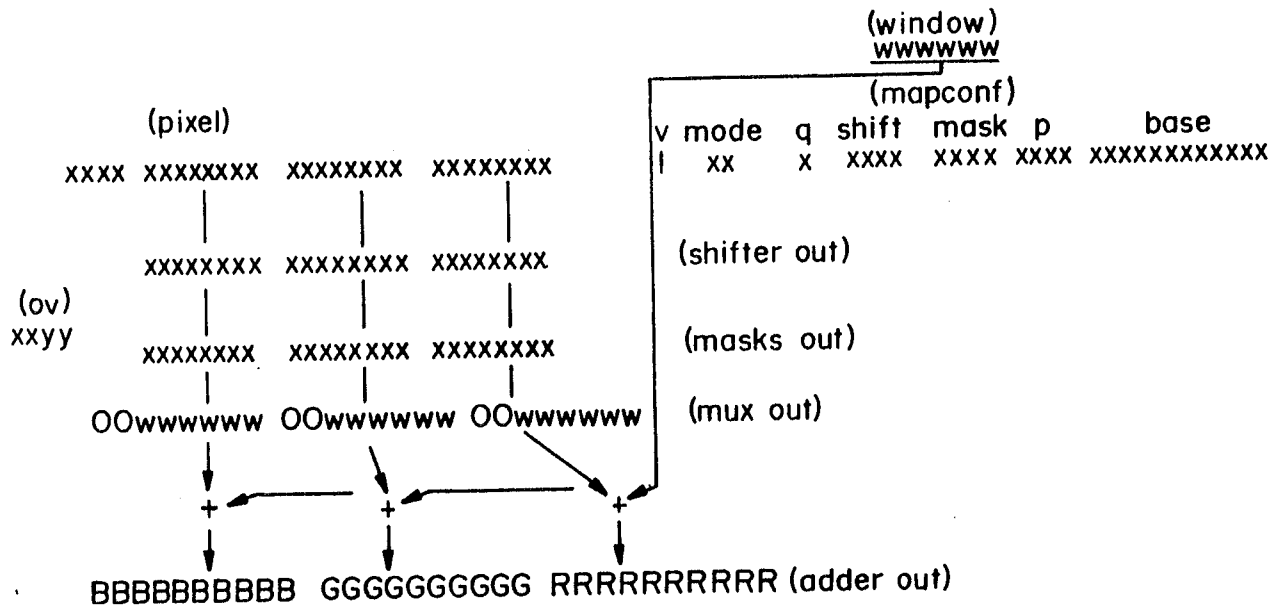
FIGS. 7A and 7B, respectively, describe a valid plane operation and the results.

FIGS. 7A and 7B show the operation of pixel map unit 40 in valid plane mode, which can be selected independent of the other modes. If this mode is indicated by the "V" bit set in the mapping configuration word 79, and the current bit from the valid planes input is also set, the pixel word 33 and the rest of the mapping configuration word 79 are not used. Rather, the window number is used directly and added to the contents of the background base register. The result is that a unique background color can be selected for each window. In the example shown the window number is 6 bits, so 64 background colors should be stored in a contiguous section of the color table beginning at the address pointed to by the background base register 94. If valid plane mode is disabled then the pixel map unit 40 operates in one of the four other modes previously described.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. A pixel mapping unit for use in a computer graphics system, the system including a color table memory and a display memory for providing a pixel data word containing a channel intensity value, the pixel data word including two or more data bits, wherein the pixel mapping unit comprises:

A. means for determining an overlay value by selecting certain ones of the data bits of the pixel data word; and B. means for determining a color table memory address from the overlay value.

2. An apparatus as in claim 1 wherein the means for determining the color table memory address comprises:

C. means for providing a base address value; and

D. means for subtracting the overlay value from the base address value to provide the color table memory address.

3. An apparatus as in claim 1 wherein the means for determining the color table memory address comprises:

C. means for providing a base address value; and

D. means for selectively determining the color table memory address in accordance with the overlay value, either by adding the channel intensity value to the base address value if the overlay value is zero, or by subtracting the overlay value from the base address value if the overlay value is non-zero.

4. An apparatus as in claim 1 wherein the means for determining the color table memory address comprises:

C. means for appending the channel intensity value to the overlay value to provide the color table memory address.

5. An apparatus as in claim 1 wherein the pixel data word includes a channel intensity value for each of a red, green, and blue color channel, the channel intensity values each including two or more data bits, and the overlay values are determined by selecting the least significant data bits of the channel values.

6. An apparatus as in claim 1 wherein the means for determining the overlay value comprises:

C. means for providing an overlay mask word, the overlay mask word having the same number of bits as the pixel data word, each bit in the overlay mask word either being enabled or disabled; and D. means for providing the overlay value, by concatenating the bits of the pixel data word indicated by the enabled bits of the overlay mask word

7. An apparatus as in claim 6 wherein the color table memory is divided into a plurality of contiguous banks, and he means for determining the color table address comprises:

E. means for appending the channel intensity value to the overlay value to provide a bank select address indicating which of the banks in the color table memory is to be enabled.

8. An apparatus as in claim 1 wherein the means for determining the overlay value selectively determines the overlay value depending upon the value of an overlay select field, and additionally comprising:

C. means for providing a plurality of mapping configuration words, with a mapping configuration word associated with each pixel data word, each mapping configuration word including an overlay select field; and D. means for selecting certain bits of the pixel data word as the overlay value when the overlay select field in the associated mapping configuration word has a first value, and for selecting other bits of the pixel data word as the overlay value when the overlay select field has a second value.

9. An apparatus as in claim 8 wherein a window number word is associated with each pixel data word, and the means for providing a plurality of mapping configuration words additionally comprises:

E. means for selecting each mapping configuration word from one of a plurality of mapping configuration words, depending upon the value of the window number word associated with each pixel data word; and F. means for generating the window number, the window number depending upon the display memory address from which the pixel data word was read.

10. A pixel mapping unit for use in a color computer graphics system, the system including a plurality of color channel intensity inputs, a color table memory, and a frame buffer memory which provides pixel data words each containing at least one channel intensity value, and the system performing a pseudocolor mapping operation wherein the same intensity value is provided to each of the channel intensity inputs, and the system performing a full color mapping operation wherein different intensity values are provided to each of the color channel intensity inputs, the pixel mapping unit comprising:

A. means for providing a mapping configuration word associated with each pixel data word; and B. means for a selecting one of the pseudocolor or full color pixel mapping operation to be carried out on a particular pixel data word in accordance with the value of the mapping configuration word associated with the pixel data word.

11. An apparatus as in claim 10 wherein a window number word is associated with each pixel data word, and the means for providing the mapping configuration word additionally comprises:

C. means for selecting one of a plurality of mapping configuration words depending upon the value of the window number word associated with each pixel data word, the window number word in turn being dependent upon the address in the frame buffer memory from which the pixel data word was taken.

12. A pixel mapping unit for use in a computer graphics system, the system including a color table memory, and the system providing pixel data words each containing at least one channel intensity value, the pixel mapping unit comprising:

A. means for providing a mapping configuration word associated with each pixel data word, B. each mapping configuration word having a bitonal mode enable field, a background offset field, and a foreground offset field, the bitonal mode enable field indicating whether a bitonal mode is enabled in which a single selected bit of each pixel data word specifies the output intensity value, the background offset field indicating a background offset address, and the foreground offset field indicating a foreground offset address;

B. a means for selecting an offset address from one of the background offset field and the foreground offset field if the bitonal mode enable field indicates that the bitonal mode is enabled;

C. means for providing a base address; and

D. means for adding the base address to the selected offset if the bitonal mode is enabled, to provide a color table memory address.

13. A pixel mapping unit for use in a computer graphics system, the system including a color table memory and a frame buffer memory which provides pixel data words each containing at least one channel intensity value, the pixel mapping unit comprising:

A. means for providing a mapping configuration word associated with each pixel data word, each mapping configuration word having a valid plane field indicating whether a valid plane mode is enabled in which one of the bits of each pixel data word indicates whether the other bits in that pixel data word are valid or not;

B. means for providing a window number word associated with each pixel data word, the window number word depending upon the frame buffer memory address from which the pixel data value was provided;

C. means for providing a color table address dependent upon the value of the window number word; and D. means for selecting the color table address in place of the pixel data values when the valid plane field indicates that the valid plane mode is enabled.

14. A pixel mapping unit for use in a graphics system which supports displaying a multiple number of windows, the system including a frame buffer memory which provides pixel data words, wherein one bit of each pixel data word is a valid plane bit, the valid plane bit indicating whether the other bits in the pixel data word contain valid pixel data, the pixel mapping unit comprising:

A. means for storing a list of background color table addresses, wherein one background color table address is stored for each window;

B. means for monitoring the value of the valid plane bit as the pixel data words are read from the frame buffer memory;

C. means for providing a window number associated with each pixel data word, the window number depending upon the frame buffer memory address from which the pixel data value was read; and D. means, connected to receive the window number, the background color table addresses, and the valid plane bit, for outputting the background color table address associated with the window number when the valid plane bit is logically true.

15. A pixel mapping unit for operating on an input pixel data word and a window number word, the input pixel data word provided by a frame buffer memory, and the window number word having a value depending upon the frame buffer address associated with the pixel data word, the pixel mapping unit providing a mapped intensity data output, the mapped intensity data output indicating an address input to a color look-up table memory, the pixel mapping unit comprising:

A. a mapping memory, connected to receive the window number at address inputs, and to provide a mapping configuration word at data outputs, the mapping configuration word containing a mode field, base address field, number of planes field, shift field, and mask field, the mode field indicating an operating instruction for the pixel mapping unit, the base address field indicating a base color table address to which the results of the operations of the pixel mapping unit are to be added, the number planes field indicating the total number of active bits in the pixel data word, the shift field indicating the number of bit positions to shift the pixel data word, and the mask field indicating which of the bits in the pixel data word are to be used as an overlay value;

B. a barrel shifter, connected to receive the pixel data and the shift field, and to provide shifted pixel data shifted by the number of bits indicated by the shift field;

C. a mask unit, connected to receive the shifted pixel data and the number of planes field, and to provide masked pixel data;

D. an overlay selector, connected to receive the pixel data, the mode field, and the mask field, and to provide an overlay value, and an overlay value complement, the overlay value taken from one or more predetermined bits of the pixel data depending upon the mode field and the mask field;

E. a multiplexer, connected to receive the mode field, and to select one of the overlay value complement and the masked pixel data as a multiplexer output, depending on the overlay value; and F. an adder, connected to add the multiplexer output and the base address field, and to provide the mapped intensity data output.

16. A pixel mapping unit for operating on a pixel data word and a window number, the input pixel data word provided by a frame buffer memory, and the window number having a value depending upon the frame buffer address associated with the pixel data word, the pixel mapping unit for providing an address to a color look-up table memory, the pixel mapping unit comprising:

A. means for selecting a variable number of bits of the pixel data word as active pixel plane bits, the number of bits so selected depending upon the window number, the active pixel plane bits including a most significant active pixel plane bit, and the active pixel plane bits occurring in any contiguous order in the pixel data word; and B. means for selecting a plurality of the bits of the pixel data word as overlay plane bits, the overlay plane bits positioned in the immediate next highest bit positions adjacent the most significant pixel plane bit, regardless of the number of active pixel plane bits; and C. means for determining the color table memory address from the overlay plane bits.

17. A pixel mapping unit as in claim 16 wherein the overlay plane bits specify an overlay value, additionally comprising:

D. means for providing a base address, the base address depending upon the window number; and E. means for adding the overlay value to the base address, to provide the color table memory address.

18. A pixel mapping unit for operating on a pixel data word and a window number, the input pixel data word provided by a frame buffer memory, and the window number having a value depending upon the frame buffer address associated with the pixel data word, the pixel mapping unit providing an address to a color look-up table memory, the pixel mapping unit comprising:

A. means for selecting a variable number of active pixel plane bits from the pixel data word, the active pixel plane bits including red, green, and blue color channel intensity values, each channel intensity value having a least significant bit position, and the active pixel plane bits occurring in any contiguous order in the pixel data word; and B. means for selecting an overlay plane bit occupying the least significant bit position of one of the color channel intensity values; and C. means for determining the color table memory address from the overlay plane bits.

19. A pixel mapping unit as in claim 18 wherein the overlay plane bit specifies an overlay value, and wherein the color table memory is divided into a plurality of contiguous banks, and the means for determining the color table address additionally comprises:

D. means for concatenating the overlay value with the channel intensity values to provide a bank select address indicating which of the banks in color table memory is to be enabled.

20. An apparatus as in claim 1 wherein the overlay value is determined by selecting the least significant bits of the pixel data word.

* * * * *